US005420571A

United States Patent [19]

Coleman et al.

[11] Patent Number: 5,420,571

[45] Date of Patent: May 30, 1995

[54] SWITCH WITH END OF LIFE PREDICTION CAPABILITY

[75] Inventors: Mark L. Coleman; Thomas A. Fletcher; Lyle D. Johnsen, all of Stephenson, Ill.

[73] Assignee: Honeywell Inc., Minneapolis, Minn.

[21] Appl. No.: 179,857

[22] Filed: Jan. 11, 1994

[51] Int. Cl.[6] ..... G08B 21/00

[52] U.S. Cl. ..... 340/644; 340/635; 340/309.15; 200/47; 364/550

[58] Field of Search ..... 340/644, 635, 309.15; 200/47

[56] References Cited

U.S. PATENT DOCUMENTS

| | | | |
|---|---|---|---|
| 4,163,360 | 8/1979 | Tanaka et al. | 58/39.5 |
| 4,598,248 | 7/1986 | Germer | 324/103 R |
| 4,742,476 | 5/1988 | Schwartz et al. | 364/550 |
| 4,992,777 | 2/1991 | Keisuke et al. | 340/644 |
| 5,021,828 | 6/1991 | Yamaguchi et al. | 355/209 |

*Primary Examiner*—Jeffery A. Hofsass

*Assistant Examiner*—Julie Lieu

*Attorney, Agent, or Firm*—William D. Lanyi

[57] ABSTRACT

A monitoring device is provided for use in association with a limit switch or similar mechanically actuated device in order to permit its end of life to be predicted. The system uses nonvolatile random access memory to store a count which represents the number of occurrences of one of two alternative events. The first event is the occurrence of a number of switch actuations and the second event is the lapse of a predetermined period of time. When either of these two events occurs, a microprocessor increments a count in the nonvolatile memory unit and clears both the clock and the volatile memory parameter. When the number stored in the nonvolatile memory represents a number of actuations estimated to be appropriately equal to the total life of the switch, this condition can be signaled to a sensor bus by a communication circuit. Alternatively, a light emitting diode can be alternately energized and de-energized to represent the number of actuations having exceeded the predicted end of life total.

14 Claims, 4 Drawing Sheets

SWITCH WITH END OF LIFE PREDICTION CAPABILITY

BACKGROUND OF THE INVENTION

1. Field of the Invention

The present invention relates generally to a device which is able to monitor its own number of actuations and predict its own end of life and, more particularly, it relates to a limit switch which is able to count its own actuation and store the value in a way which reduces the number of lost actuations while working within the capabilities of its constituent components.

2. Description of the Prior Art

In many applications, devices are used to control the operation of machinery, assembly lines or other types of equipment. A typical example of this type of device is the limit switch which is very well known to those skilled in the art. In operation, the limit switch is typically located proximate the path of an object being manipulated by the equipment or, alternatively, proximate the path of a portion of the equipment. When the limit switch is actuated, it typically makes or breaks electrical power between two preselected locations. In addition, limit switches can be used to provide a signal to a controller that a preselected event has occurred. These and many other applications of limit switches are well known to those skilled in the art.

Like most mechanical devices, limit switches have a certain lifetime after which it can be expected that the switch will fail for some mechanical reason. For example, components within the limit switch can wear out due to normal frictional effects. In addition, components may fail because of repeated flexing such as when a spring is cycled. Another possible cause for a switch failure is contact erosion that occurs between a moveable contact and a stationary contact. These and other causes can lead to the failure of a switch after a certain number of operations. Empirical studies can determine the expected life of a device based on statistical information obtained from many thousands of devices. Since the load across the contacts of limit switches in many applications is either controlled or limited, it is possible to predict the expected life of a switch by using load-life curves that describe the expected number of actuations in the life of a switch as a function of the current load on the switch at a given voltage potential. By using curves like these, the expected life of a limit switch can be predicted and a reasonable time for replacement can be determined so that catastrophic failure of the switch is avoided. This information can be used to predict the expected life of the switch.

If a means is provided for counting the actuations of a device, such as a limit switch, the number of actuations performed during the life of the switch can then be used as a criterion for determining when the device should be replaced as part of a preventative maintenance program. However, previous attempts to monitor the number of actuations of devices such as limit switches have proven to be difficult and counterproductive. For example, the number of operations of a limit switch can be counted by another mechanical device, but that device will also experience the normal reasons for failure, such as frictional wear. Therefore, the device used to count the operations of the limit switch may fail before the limit switch itself. Electronic means can be used to count the actuations of a limit switch, but this technique also exhibits certain inherent problems. For example, if volatile storage devices are used, a power failure can cause the stored information to be lost. If a nonvolatile storage device is used, the number of data storage operations is often limited to a certain maximum limit and the permitted number of storage operations may, in fact, be less than the expected lifetime of the switch that is being monitored.

Another problem related to the monitoring of switch actuations is the costs. In some situations, the costs of monitoring the number of operations of a limit switch can exceed the costs of the switch itself and therefore make the effort counterproductive. In addition, when devices such as limit switches are monitored to maintain a count of their actuations, it is necessary to determine the number of actuations in order to decide on when preventive maintenance replacement should occur. It is sometimes difficult to determine the precise count stored in the limit switch and inform the user of the number of actuations. The replacement of the switch is sometimes less expensive than the determination of the number of counts stored at any given time.

In view of the above, few attempts have been made to monitor the life of a limit switch even though the benefits are widely recognized. If a means is provided to facilitate the monitoring of the number of actuations of a mechanical device such as a limit switch, significant reduction in operating costs can be achieved. For example, if a complex assembly line or piece of equipment utilizes hundreds of limit switches, it might be extremely expensive to shut down the assembly line or piece of equipment for the purpose of replacing a limit switch that has failed during operation. This type of catastrophic failure can result in costly downtime or possible damage to equipment. It would be very beneficial if, during a required shutdown to replace a limit switch, all of the other switches on the assembly line or piece of equipment could be quickly and easily examined to determine whether they are also approaching their end of life. For those switches that have not reached their end of life number of actuations, but are close to that number, they can be replaced during the same shutdown of the assembly line or piece of equipment as part of a preventative maintenance program.

SUMMARY OF THE INVENTION

The present invention provides a means for counting the number of actuations of a device, such as a limit switch, and storing the count in a manner which is easily accessible by external equipment or by an operator. In addition, the present invention performs this function in a way which does not risk the loss of important stored data and does not exceed the capacity of electronic storage media used for these purposes.

A switch, or other mechanically actuated device, made in accordance with the present invention comprises a means for measuring a preselected period of time. This measuring means can be a clock or other timing device that is capable of recording the duration of elapsed time between two preselected events. The present invention further comprises a first means for recording the count of the number of actuations of the switch during a preselected period of time. This first recording means can be the volatile random access memory of a microprocessor. The first recording means is responsive to an actuator of the switch. The present invention also comprises a second means for recording the occurrence when the recorded count is equal to a predetermined magnitude. In addition, the second recording means also monitors the passage of a preselected period of time. As an example, the second recording means can react to the count equaling or exceeding 250 actuations. In addition, the second recording means can also react to the passage of a preselected period of time. For example, the programmable period may be equal to one hour since the preceding occurrence of either the lapse of the period of time or the count being equal to the predetermined magnitude of actuations. In addition, the second recording means could be initiated in response to a power failure. In operation, this second recording means could be nonvolatile memory and would store the count currently maintained by the first recording means when the count reaches a predetermined number, such as 256. Even if the count in the first storing means does not reach the magnitude of 256, the second recording means would react to the passage of eight hours if that occurred first. The second recording means also comprises a means for resetting the count and the clock upon the first occurrence.

The present invention also comprises a means for counting the number of the first occurrences described above. In addition, it comprises a means for comparing the number of first occurrences to a predetermined programmable value. For example, if the number of first occurrences represents a total number of actuations that equals 20 million, the comparison by the comparing means would compare the value that represents the 20 million actuations to a predetermined value that represents the expected lifetime of the switch. The present invention comprises a means for providing a signal when the number of first occurrences exceeds the predetermined value. When this occurs, it is assumed that the switch has been actuated, either actually or effectively a sufficient number of times for the switch to be replaced in anticipation of its end of life.

Upon the exceedance of the predetermined value by the number of stored occurrences, several actions can be taken. One action would be for the limit switch to provide an operator detectable signal, such as a flashing light emitting diode. Another action could involve the transmission of a signal onto a signal bus for receipt by a central controller. The flashing light emitting diode is especially advantageous in situations where the limit switch is a stand alone application. The communication to a central controller would be most appropriate in a situation in which the limit switch is connected to a signal bus for coordinated operation with a plurality of other switches.

BRIEF DESCRIPTION OF THE DRAWINGS

The present invention will be more fully understood from a reading of the Description of the Preferred Embodiment in conjunction with the drawings, in which.

DESCRIPTION OF THE PREFERRED EMBODIMENT

Figure 1:
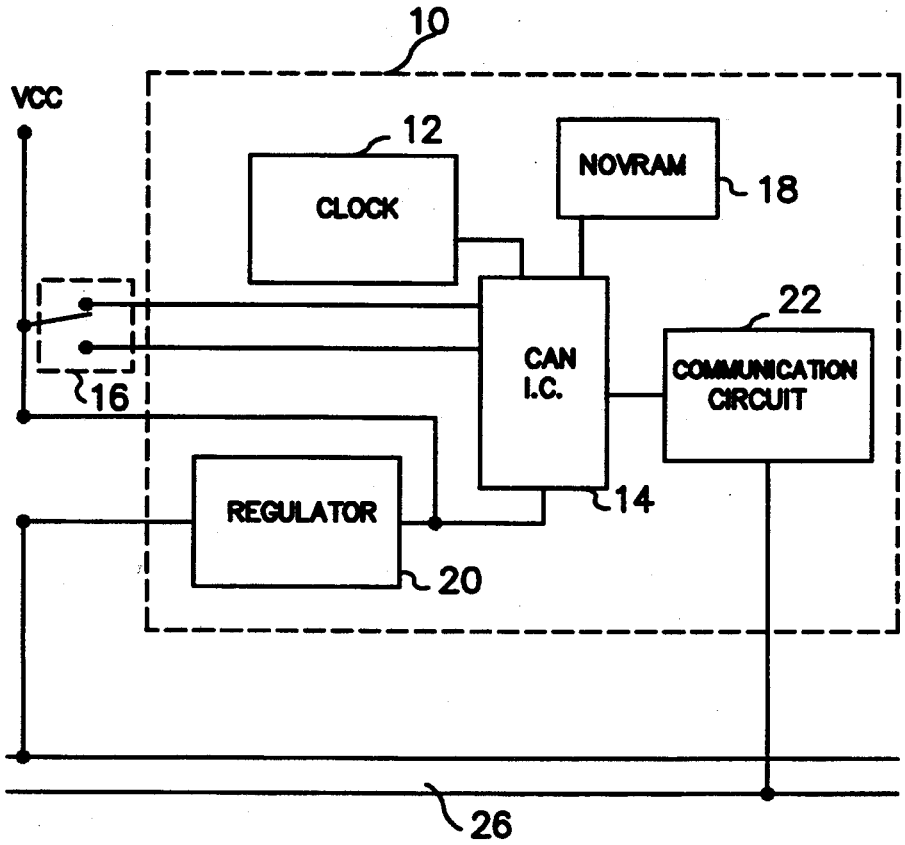
FIG. 1 illustrates a schematic representation of the circuit of the preferred embodiment of the present invention.

Throughout the Description of the Preferred Embodiment, like components will be identified by like reference numerals.

FIG. 1 illustrates a device, such as a limit switch, which is provided with the ability to monitor its usage and determine the imminence of its own end of life. The device 10, comprises a clock 12 which serves as a means for measuring a preselected period of time. The clock, as is well known to those skilled in the art, can comprise a crystal oscillator or other means for measuring elapsed time. One embodiment of the present invention utilizes a Controller Area Network (CAN), such as that developed by Robert Bosch GmbH and commercially available from Motorola, Inc., which comprises a microprocessor. This is shown schematically in FIG. 1 as a CAN integrated circuit 14. The microprocessor capability of the CAN integrated circuit 14 allows it to function as a temporary data storage apparatus that is responsive to an actuator of the device 10. The actuator is schematically illustrated as the switch 16. The first recording means, which is the microprocessor of the CAN integrated circuit 14, is responsive to the switch 16 and serves as the first means for recording the count of the number of actuations of the switch 16 during a preselected period of time that is measured by the clock 12.

The microprocessor portion 50 (shown in FIG. 4) of the CAN integrated circuit 14 provides a second means for recording the first occurrence of the count, described above, being equal to a predetermined magnitude. In other words, the microprocessor maintains a count which is incremented each time the switch 16 is actuated. It also stores a reference magnitude with which the increasing count can be compared. When the count representing the number of actuations of switch 16 equals or exceeds the stored reference magnitude, the microprocessor reacts to this occurrence by storing a value in the nonvolatile random access memory (NOVAM) 18. The microprocessor within the CAN integrated circuit 14 also monitors the elapsed time since a previous occurrence. If a predetermined period of time elapses prior to the occurrence of a sufficient number of actuations of the switch 16 to cause the microprocessor to store an indication of this occurrence in the nonvolatile random access memory unit 18. In other words, the value stored in the nonvolatile random access memory unit 18 can be incremented upon the occurrence of either of two alternative events, whichever occurs first. The first event is the number of actuations of switch 16 being equal to a predetermined threshold magnitude stored in the volatile memory of a CAN integrated circuit microprocessor. The second event is the passage of a predetermined period of time measured by the clock 12. The first of these two events to occur will result in the microprocessor in the CAN integrated circuit recording the first occurrence in the nonvolatile memory unit 18.

The microprocessor 50 of the present invention is also used as a means for comparing the number of first occurrences, which are stored in the nonvolatile memory unit, with a predetermined programmable reference value stored in the nonvolatile memory unit. This is also stored in the NOVRAM and is programmable by the user. When the number of occurrences stored in the nonvolatile memory is equal to the predetermined reference value, this is indicative that the switch has experienced a sufficient number of actuations to conclude that it has reached its predicted time for replacement.

With continued reference to FIG. 1, it should be realized that devices such as the nonvolatile random access memory unit 18 have a limited number of writes to their memory that can be executed without exceeding the capability of the memory device. For example, one type of nonvolatile random access memory is specified to be able to experience over 100 thousand write cycles at a minimum. One problem that occurs is that the expected life of the switch 16, measured in actuations, greatly exceeds the permissible number of write cycles of the nonvolatile random access memory unit 18. On the other hand, while the microprocessor 50 of the CAN integrated circuit 14 is provided with volatile memory that is capable of operating to maintain the count of a very high number of switch actuations, the volatility of its memory limits its usefulness for the purpose of storing the very large number necessary to maintain an ongoing count of the total actuations experienced by the switch 16. As will be described in greater detail below, the present invention advantageously combines the attributes of the volatile memory 52 associated with the microprocessor 50 in the CAN integrated circuit 14 and the nonvolatile memory provided by the random access memory unit 18.

FIG. 1 also shows a regulator 20 which is used to provide regulated power to the CAN integrated circuit, the clock 12 and the nonvolatile random access memory unit 18. The communication circuit 22 permits the CAN integrated circuit 14 to communicate with a bus 26. The bus 26 is illustrated schematically in FIG. 1 to represent any means for transmitting signals between the device 10 and other devices that are also connected to the bus 26. One possible bus configuration is the sensor actuator bus which is described in U.S. patent application Ser. No. 07/993,831 and U.S. patent application Ser. No. 07/993,180 that were filed on Dec. 18, 1992 by Hans Sitte and assigned to the assignee of the present application. However, it should be understood that other types of buses can be used in association with the present invention. In addition, it should be understood that the present invention can be utilized in a stand alone application without being connected to a bus. When the present invention is connected to a bus, the communication circuit 22 is used to transmit the information stored in the nonvolatile random access memory unit 18 to the bus according to the proper protocol as determined by the CAN integrated circuit's microprocessor 50.

Figure 2:
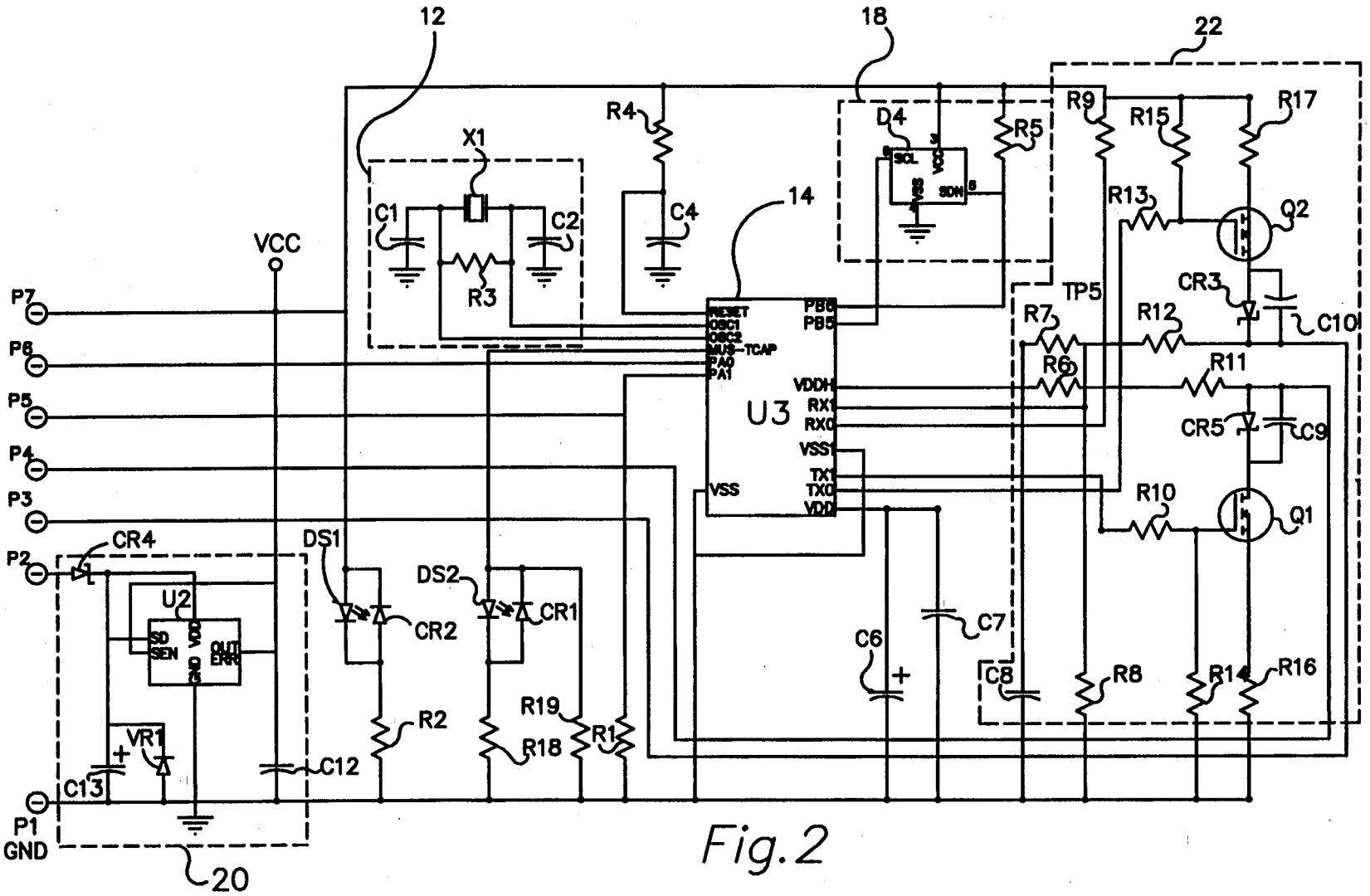
FIG. 2 illustrates a detailed illustration of the circuit shown in FIG. 1.

FIG. 2 illustrates a more detailed version of the circuit that is schematically shown in FIG. 1. The type or value of the component shown in FIG. 1 are identified in Table I shown below.

TABLE I

| Reference | Type or value |
|---|---|
| C1 | 18pF |
| C2 | 18pF |
| C4 | 1.5F |
| C6 | 1.5F |
| C7 | 1000pF |
| C8 | 0.01F |
| C9 | 1000pF |
| C10 | 1000pF |
| C12 | 1.0 |
| C13 | 1.0F |
| CR1 | MMBD914 (Motorola) |
| CR2 | MMBD914 (Motorola) |
| CR3 | LL103A (ITT) |

TABLE I-continued

| Reference | Type or value |
|---|---|
| CR4 | LL103A (ITT) |
| CR5 | LL103A (ITT) |
| DS1 | HLMP-1790 (Hewlett Packard) |
| DS2 | HLMP-1485 (Hewlett Packard) |
| R1 | 100KΩ |
| R2 | 560Ω |
| R3 | 2.2MΩ |
| R4 | 4.7KΩ |
| R5 | 10KΩ |
| R6 | 7.5KΩ |
| R7 | 7.5KΩ |
| R8 | 182KΩ |
| R9 | 182KΩ |
| R10 | 150Ω |
| R11 | 27KΩ |
| R12 | 27KΩ |
| R13 | 150Ω |
| R14 | 10KΩ |
| R15 | 10KΩ |
| R16 | 10Ω |
| R17 | 10Ω |
| R18 | 560Ω |
| R19 | 100KΩ |
| Q1 | MMBF170 (Motorola) |
| Q2 | BSS84 (Siemens) |
| U2 | LP2951CM (National Semiconductor) |
| U3 | 68HC705-X4DW (Motorola) |
| U4 | 24CO1 (X1COR) |
| VR1 | 36V |
| X1 | 16MHZ (Epson) |

With continued reference to the circuit of FIG. 2, the circuit points illustrated at the left side of FIG. 2 are intended to be appropriately connected as described below. Circuit P7 is maintained at a regulated 5 volts by the regulator 20. Circuit point P6 is connected to a normally open contact of a switch and a circuit point P5 is connected to the normally closed contact of the switch. Circuit point P4 is connected to the communication line (low) and circuit point P3 is connected to the communication line (high). Circuit point P2 is connected to a nine to twenty-five volt source and circuit P1 is an electrical ground.

During operation of the present invention, voltage changes sensed at connection points P6 and P5 permit the microprocessor 50 to monitor the actuations of an associated switch, such as a limit switch. During operation of the device, the microprocessor 50 continually monitors contacts P6 and P5 and also monitors an input provided by the clock 12. If either of two predefined events occur, the occurrence is recorded in the nonvolatile random access memory unit 18. The first event is a predetermined number of actuations of the associated switch. As an example, the microprocessor 50 can be programmed to recognize the occurrence of 256 actuations of the switch and, in response to this occurrence, change the count stored by the random access memory 52. Alternatively, the microprocessor 50 can also be programmed to monitor the lapse of time measured by the clock 12. For example, if eight hours has elapsed since the previous change of the value stored by the nonvolatile memory 18, the microprocessor can react to that passage of time regardless of the number of switch actuations that have occurred since the preceding change of the count stored by the nonvolatile memory. When either of these two occurrences happen, the microprocessor changes the count stored by the nonvolatile random access memory unit 18 and clears both the clock count and the switch actuation count. This begins a new cycle during which the microprocessor 50 will again monitor the number of switch actuations and the passage of time to determine if either of the two events occurs.

It should be understood that the time limit used by the microprocessor to monitor the passage of time measured by the clock 12 and the actuation limit used by the microprocessor to monitor the number of actuations that have occurred with respect to the switch 16 should be chosen wisely to make sure that the number of actuations used as a threshold by the microprocessor 50 is approximately the number of actuations expected during the time period used by the microprocessor to monitor the clock. A significant mismatch between these two values will result in an inefficient usage of the present invention.

If the count stored in the nonvolatile memory is incremented each time 256 switch actuations occur, the nonvolatile memory in conjunction with the microprocessor can record 25 million actuations of the switch 16 without exceeding the capabilities of the nonvolatile random access memory unit 18. In addition, even if the preselected time period chosen for comparison to the clock by the microprocessor is once each hour, the number of write operations allowed to a typical nonvolatile random access memory 18 will permit the system shown in FIG. 1 to operate for over 11 years without exceeding the capabilities of the nonvolatile random access memory unit 18

When the microprocessor, in association with the nonvolatile random access memory, determines that the switch is approaching its expected end of life, the present invention is equipped to notify either an operator or a remote controller of this situation. In an application where the present invention is associated with a sensor bus 26, the communication circuit 22 transmits either a warning signal or the accumulated count stored by the nonvolatile memory 18, or another appropriate signal, to the remote controller so that the controller can be alerted that the end of life of the device is approaching. Alternatively, if the present invention is associated with a switch that is not connected to a bus 26, alternative means can be used to notify an operator of this occurrence.

Figure 3:
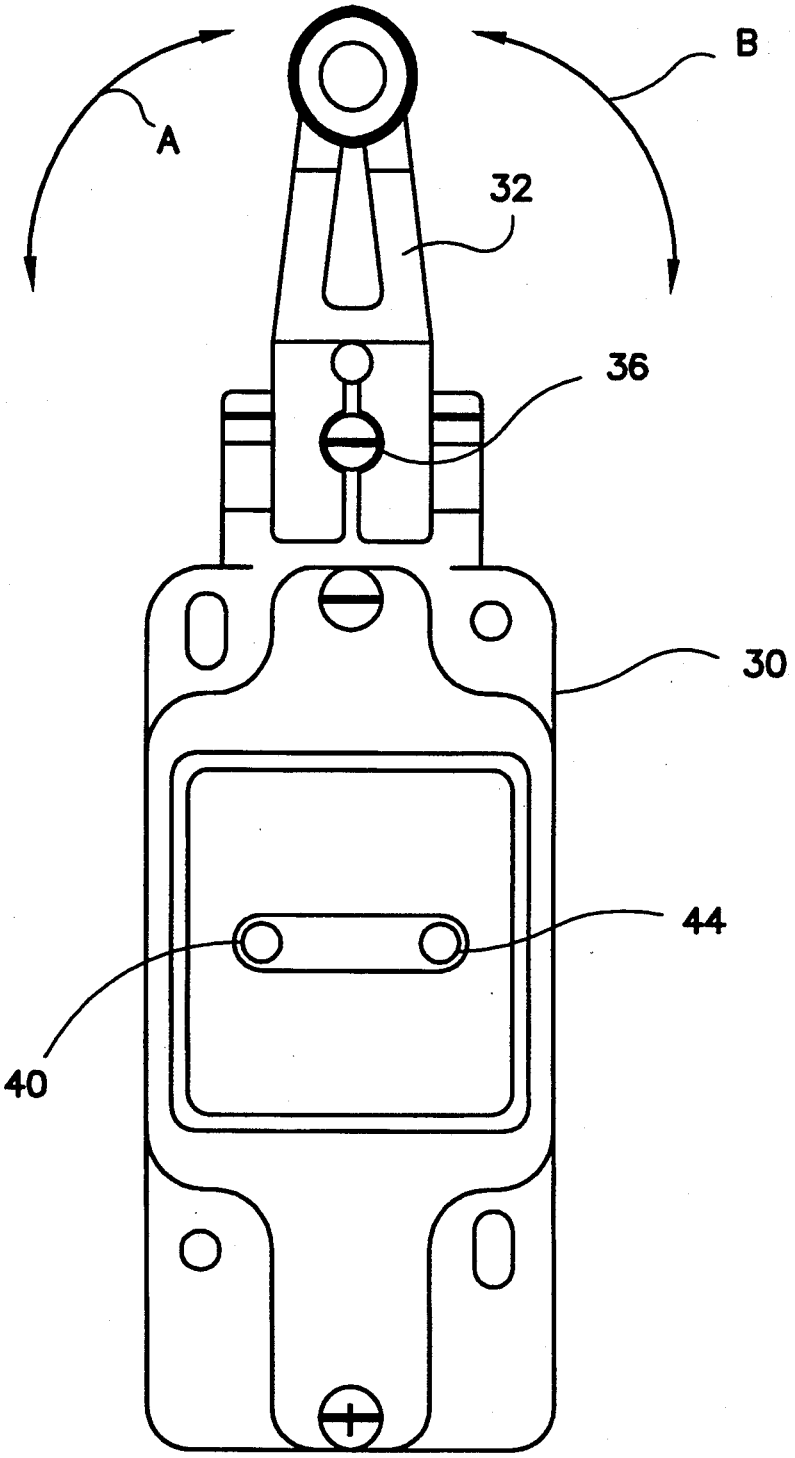
FIG. 3 illustrates a front view of a limit switch made in accordance with the present invention.

FIG. 3 is an exemplary illustration of a limit switch 30 that has an actuator arm 32 that is intended to pivot about a center of rotation 36 as illustrated by arrows A and B. Each actuation of the arm 32 can be sensed by the microprocessor contained within the body of the switch. In other words, circuit points P6 and P5 can be connected to the mechanical actuator within the switch which is used to change the electrical connection of the switch. In a typical switch of this type shown in FIG. 3, two light emitting diodes are provided. A first light emitting diode 40 represents the connection of electrical power to the switch. In other words, when the switch and its internal components are provided with electrical power from an external source, light emitting diode 40 is energized. Light emitting diode 44 represents the actuation status of the switch. In various embodiments of the present invention, light emitting diode 44 can be energized when a normally opened switch is closed or when a normally closed switch is opened. When the number of total actuations represented by the value stored in the nonvolatile random access memory unit 18 exceeds a predicted end of life threshold for the limit switch, one of the two light emitting diodes, 40 or 44, can be alternatively energized and de-energized to attract the attention of an operator. In a preferred embodiment of the present invention, light emitting diode 40 is intermittently energized and de-energized for this purpose while the light emitting diode 44 is used in its traditional manner to illustrate the actuation of the switch.

Figure 4:
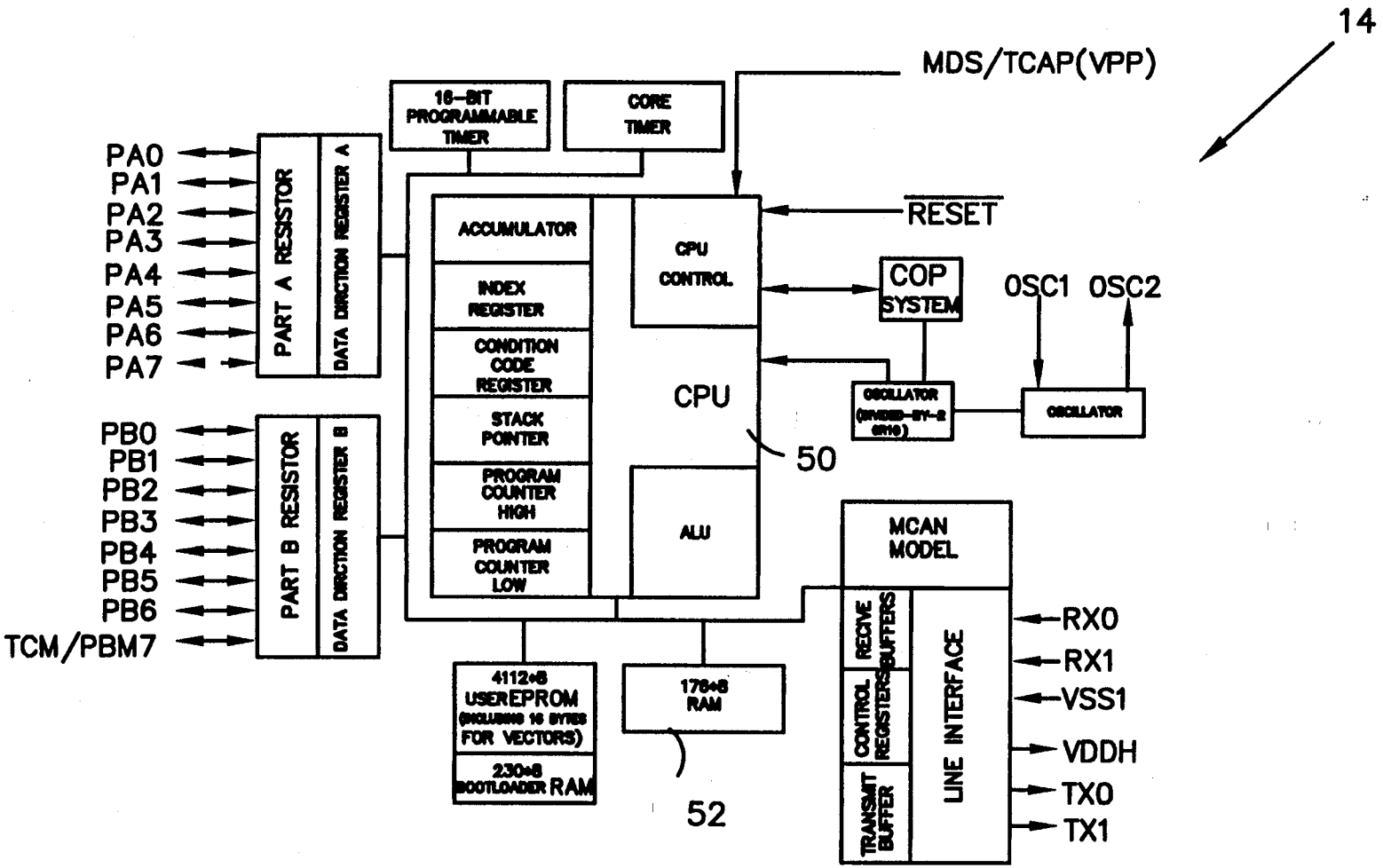
FIG. 4 illustrates a block diagram of one embodiment of the present invention.

FIG. 4 shows a particular configuration of the CAN integrated circuit 14 shown in FIG. 2. The schematic representation in FIG. 4 represents the particular CAN integrated circuit 14 that is available in commercial quantities from Motorola Inc. and identified by number MC68HC05X4. The central processing unit 50 cooperates with the volatile random access memory 52 to provide the first means for recording the count of the number of actuations of the switch during the preselected period of time described above. In a preferred embodiment of the present invention, the configuration shown in FIG. 4 is utilized for many other purposes that relate to the connection of the limit switch to a sensor bus. However, the presence of a microprocessor 50 within the CAN integrated circuit 14 facilitates the implementation of the first storing means.

The present invention solves a perplexing problem relating to the monitoring of the end of life for a switch or similar mechanical actuated device. It combines the reliability and power fail resilience of a nonvolatile random access memory with the virtually limitless number of storage cycles capable through the use of a microprocessor having volatile memory even though memory is subject to data loss in the event of a power failure. By selectively combining these two types of storage media along with the logical procedure of monitoring both time and switch actuations by the microprocessor. One of the advantages of the dual logical monitoring procedure performed on the microprocessor is that it avoids several problems that could otherwise occur. If the microprocessor monitored only the number of actuation's by the switch 16, a power failure could occur immediately prior to the occurrence of the 256th actuation of the switch. When this occurs, the 249 actuations that have already occurred would be lost because of the volatile nature of the memory used in association with the microprocessor. If on the other hand, only the passage of time measured by the clock 12 was used for these purposes, the microprocessor would react solely to time and the number of actuations of the switch 16 would become irrelevant to the monitoring of its life expectation. Both of these techniques are insufficient and could lead to serious errors in life prediction. Therefore, the present invention provides a means for measuring a large number of cycles of a switch in a manner which increases the likelihood of maintaining an accurate count regardless of the likelihood of power failures, the number of actuations expected per unit of time and the particular application in which the switch is used. Although it is not necessary in every embodiment of the present invention, the circuit shown in FIG. 2 can be provided with a power fail routine that responds to a loss of power and saves the contents of the volatile memory in the event that the microprocessor 14 is deprived of power.

Beside predicting the end of it's own life, the present invention serves another useful purpose. If a number of limit switches are employed in association with a single piece of machinery or a single assembly line, and one of the limit switches in the system must be replaced because of a failure or because its predicted time for replacement has elapsed, the present invention permits each of the limit switches to be examined to determine if they are approaching their end of life but have not yet reached it. If this is the case, those aging limit switches can be replaced while the machine or assembly line is shut down instead of waiting for their predicted time for replacement to occur in the near future. This reduces downtime significantly.

The embodiments of the invention in which an exclusive property or right is claimed are defined as follows:

1. A switch, comprising:

means for measuring elapsed time;

means, responsive to an actuator of said switch, for recording a first counting value of the number of actuations of said switch subsequent to a preselected event;

means for detecting a first occurrence of either (a) said first counting value being equal to a first predetermined magnitude or (b) a lapse of a preselected period of said elapsed time subsequent to said preselected event, whichever occurs first after monitoring status of both (a) said first counting value being equal to a first predetermined magnitude and (b) a lapse of a preselected period of said elapsed time subsequent to said preselected event;

means for resetting said first counting value and said elapsed time measuring means upon said first occurrence;

means for adding said first counting value to a second counting value in response to said detecting means; and means for providing a signal when said second counting value exceeds a second predetermined magnitude.

2. The switch of claim 1, wherein:

said signal is an intermittently activated light emitting diode.

3. The switch of claim 1, wherein:

said switch is a limit switch.

4. The switch of claim 1, wherein:

said switch is a mechanically actuated switch.

5. The switch of claim 1, wherein:

said switch is connectable in signal communication with a plurality of other electrical devices.

6. The switch of claim 5, wherein:

said signal is transmittable to one of said plurality of electrical devices.

7. A switch, comprising:

a clock configured to measure elapsed time subsequent to a predetermined event;

a first counter responsive to an actuator of said switch for maintaining a first count representing a number of actuations of said actuator subsequent to said predetermined event;

a second counter for maintaining a second count;

first means for comparing said first count to a first predetermined magnitude and for comparing said elapsed time to a second predetermined magnitude, said first count being added to said second count when either said first count equals said first predetermined magnitude or said elapsed time equals said second predetermined magnitude;

means for resetting said first count and said elapsed time when said first count is added to said second count;

second means for comparing said second count to a third predetermined magnitude; and means for providing a signal when said second count equals said third predetermined magnitude.

8. The switch of claim 7, wherein:

said signal is an intermittently activated light emitting diode.

9. The switch of claim 7, wherein:

said switch is a limit switch.

10. The switch of claim 7, wherein:

said switch is a mechanically actuated switch.

11. The switch of claim 7, wherein:

said switch is connectable in signal communication with a plurality of other electrical devices.

12. The switch of claim 11, wherein:

said signal is transmittable to one of said plurality of electrical devices.

13. The switch of claim 7, wherein:

said first counter is a volatile memory device.

14. The switch of claim 13, wherein:

said second counter is a nonvolatile memory device.

* * * * *